US007395901B2

(12) United States Patent
Hayashi

(10) Patent No.: US 7,395,901 B2
(45) Date of Patent: Jul. 8, 2008

(54) LIFT DEVICE FOR INDUSTRIAL VEHICLE

(75) Inventor: Hirohito Hayashi, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 0 days.

(21) Appl. No.: 11/487,257

(22) Filed: Jul. 14, 2006

(65) Prior Publication Data

US 2007/0012520 A1 Jan. 18, 2007

(30) Foreign Application Priority Data

Jul. 15, 2005 (JP) ..... 2005-206327

(51) Int. Cl.
*B66F 9/06* (2006.01)
*B66F 9/22* (2006.01)
*B66B 7/00* (2006.01)

(52) U.S. Cl. ..... 187/228; 187/229; 187/234; 187/413

(58) Field of Classification Search ..... 187/228, 187/229, 234, 413
See application file for complete search history.

(56) References Cited

U.S. PATENT DOCUMENTS 2,513,928 A * 7/1950 Frischmann ..... 187/228
3,289,870 A * 12/1966 Quayle ..... 187/228
3,777,853 A * 12/1973 Miller ..... 187/228
3,894,616 A * 7/1975 Kawanishi et al. ..... 187/228
3,968,859 A * 7/1976 Ehrhardt ..... 187/228
3,987,870 A * 10/1976 Wojtyna ..... 187/228
4,026,432 A * 5/1977 Abels ..... 414/635
4,244,449 A * 1/1981 Renk et al. ..... 187/228
4,503,936 A * 3/1985 Rice ..... 187/228
4,592,449 A * 6/1986 Sakata et al. ..... 187/228
4,621,711 A * 11/1986 Miyashige et al. ..... 187/228
4,683,987 A * 8/1987 Sakata et al. ..... 187/228
5,992,571 A * 11/1999 Lee ..... 187/228

FOREIGN PATENT DOCUMENTS

| | | |
|---|---|---|
| GB | 1075671 | 7/1967 |
| JP | 2002-020087 | 1/2002 |
| JP | 2004-359445 | 12/2004 |
| SU | 628072 | 8/1978 |

* cited by examiner

*Primary Examiner*—Peter M. Cuomo
*Assistant Examiner*—Eric Pico
(74) *Attorney, Agent, or Firm*—Morgan & Finnegan, LLP

(57) ABSTRACT

A lift device for an industrial vehicle includes a hydraulic cylinder provided substantially upright between masts and having a piston rod, a pulley provided on a lateral side of an upper end portion of the piston rod, a lift bracket connected to a chain wound around the pulley and movable up and down through the chain by extension and retraction of the piston rod, a hose provided for supplying hydraulic fluid to an attachment installed on the lift bracket, and a guide mechanism provided on a top end of the piston rod for guiding the hose. The guide mechanism includes a plurality of rollers, a support member rotatably supporting the plurality of rollers, and an endless band fitted around the plurality of rollers so as to form an arc-shaped guide surface for supporting the hose. The endless band travels around the plurality of rollers with movement of the hose.

1 Claim, 6 Drawing Sheets

LIFT DEVICE FOR INDUSTRIAL VEHICLE

BACKGROUND

The present invention relates generally to a lift device and more specifically to a lift device for an industrial vehicle which is equipped with a guide mechanism for guiding a hose.

In a forklift truck as an industrial vehicle, its lift bracket may be equipped with various kinds of attachments which are designed to perform different kinds of operations. In this case, hydraulic piping is needed for supplying hydraulic fluid for actuating the attachment.

A conventional lift device for an industrial vehicle is disclosed in Japanese Patent Application Publication No. 2002-20087. The lift device for the industrial vehicle (hereinafter referred to merely as "lift device") is a lift device for a three-stage mast forklift truck. The lift device has a hydraulic cylinder located between the spaced masts. At the top end of the piston rod of the hydraulic cylinder is supported a pulley which has two grooves for guiding a chain and a hose, respectively. The chain is connected to a lift bracket and wound around the pulley along one of the grooves. The hose which is used for supplying hydraulic fluid to an attachment installed on the lift bracket is wound around the pulley along the other groove. The lift bracket is movable up and down relative to the masts according to the extension and the retraction of the piston rod. While the lift bracket are moved up and down, the pulley guides the chain and the hose. In this case, the hose and the chain are reversibly moved while being guided by the pulley.

The lift device provides a good front view to an operator of the vehicle. However, this advantage is limited to the front view in lateral directions, and the pulley at the top end of the piston rod obstructs the front view of the operator in vertical direction. Further improvement of the front view may be accomplished, for example, by reducing the pulley diameter. However, the reduction of the pulley diameter is limited because of the restriction by mechanical properties of the hose, performance of hydraulic control and the like. In a vehicle having full free lift masts, a distance for which the lift bracket is raised without raising the masts is defined as a free lift distance. When the pulley is provided on the top end of the piston rod, the free lift distance is reduced by the length corresponding to the diameter of the pulley.

The problems with the lift device of Japanese Patent Application Publication No. 2002-20087 are solved by a lift device which is disclosed in Japanese Patent Application Publication No. 2004-359445. The lift device for an industrial vehicle according to this Publication includes a guide pulley which is provided on a lateral side of the upper end portion of the piston rod of the hydraulic cylinder for guiding a chain, a lift bracket which is connected to the chain wound around the pulley and operable to rise and lower through the pulley according to the extension and the retraction of the piston rod, and a plurality of hoses for supplying hydraulic fluid to an attachment installed on the lift bracket. A plate-like roller-mounting member is provided on the top of the upper end portion of the piston rod, and a plurality of guide rollers are mounted on the roller-mounting member for guiding the plurality of hoses. Each guide roller has guide grooves formed with a curvature, and the hoses are received in and wound around the guide grooves. The guide rollers are rotatable and arranged along an arc, thereby guiding the hoses in a state curved along the guide grooves. The grooves of each guide roller serve to prevent the hoses from falling off from the guide rollers. The lift device which uses the plurality of guide rollers in place of a pulley for guiding the hoses solves problems of the life device disclosed in Japanese Patent Application Publication No. 2002-20087 concerning the vertical front view and the free lift distance.

In the lift device of Japanese Patent Application Publication No. 2004-359445, however, the hoses which are guided by the plurality of guide rollers are inevitably placed in point contact therewith. Such point contact between each hose and each guide roller produces local contact pressure against the hose, which may damage the hose. Since the plurality of guide rollers guide the hoses while in point contact therewith, the hoses tend to be guided in such a manner that they climb over each guide roller and, therefore, the hoses are not guided smoothly. Furthermore, since the diameter of the guide rollers is small, the guide rollers rotate at a high speed in guiding the hoses, so that the hoses tend to slip easily relative to the guide rollers and the surfaces of the hoses may be damaged, accordingly. Replacing the damage hose with a new one is a laborious and time-consuming work because the hydraulic fluid in the hose must be removed before the hose is removed for the replacement. Additionally, hydraulic fluid or oil may leak accidentally from the hose during the above replacement work thereby to impair the working environment. Thus, the frequency of replacing the hose need be reduced as much as possible by preventing the hose from damage.

The present invention is directed to a lift device for an industrial vehicle which prevents the damage to a hose which is guided by a guide mechanism which dispenses with a pulley.

SUMMARY

According to the present invention, a lift device for an industrial vehicle includes masts, a hydraulic cylinder provided substantially upright between the masts and having a piston rod, a pulley provided on a lateral side of an upper end portion of the piston rod, a chain wound around the pulley, a lift bracket connected to the chain and movable up and down through the chain by extension and retraction of the piston rod, a hose provided for supplying hydraulic fluid to an attachment installed on the lift bracket, and a guide mechanism provided on a top end of the piston rod for guiding the hose. The guide mechanism includes a plurality of rollers, a support member rotatably supporting the plurality of rollers, and an endless band fitted around the plurality of rollers so that the endless band forms an arc-shaped guide surface for supporting the hose. The endless band travels around the plurality of rollers with movement of the hose.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
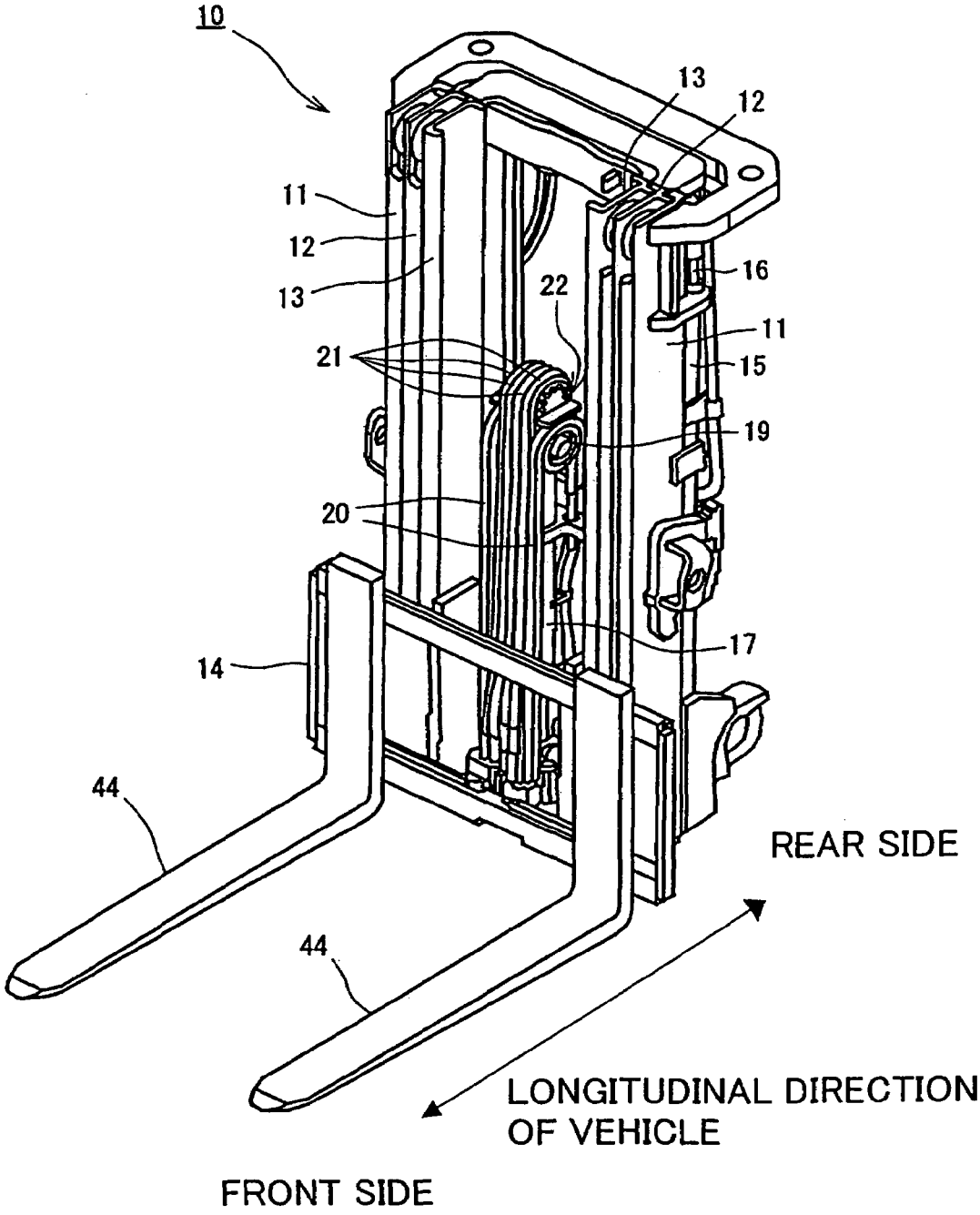
FIG. 1 is a perspective view of a lift device according to a preferred embodiment of the present invention.

The following will describe a lift device for an industrial vehicle according to a preferred embodiment of the present invention with reference to FIGS. 1 through 5. The lift device 10 of the preferred embodiment is designed for application to a three-stage full free lift mast forklift truck as an industrial vehicle. FIG. 1 shows a perspective view of the lift device 10. As shown in FIG. 1, the lift device 10 includes a pair of laterally spaced outer masts 11 which is provided at the front of the vehicle and a pair of laterally spaced middle masts 12 which is provided on the inner side of the outer masts 11. The middle masts 12 are movable up and down along the outer masts 11. The lift device 10 includes a pair of laterally spaced inner masts 13 which is provided on the inner side of the middle masts 12. The inner masts 13 are movable up and down along the middle masts 12. The lift device 10 further includes a lift bracket 14 which is provided at the inner masts 13. The lift bracket 14 is movable up and down along the inner masts 13. Various kinds of attachments are attachable to and detachable from the lift bracket 14.

A rear cylinder 15 is provided behind each middle mast 12 along its adjacent outer mast 11 and hydraulically-operated. Each rear cylinder 15 has a piston rod 16 connected at its top end to the upper portion of the respective middle mast 12. A pulley (not shown) is provided at the back surface of the upper portion of each middle mast 12 in such a way that the axis of the pulley extends in longitudinal direction of the vehicle. A lift chain (not shown) is wound around each pulley. The lift chain is connected at one end thereof to the upper portion of the respective outer mast 11 and at the other end thereof to the lower portion of the respective inner mast 13. Thus, as the piston rods 16 of the rear cylinders 15 rise, the middle masts 12 are moved upward along the outer masts 11 through the lift chains and the inner masts 13 are also moved upward along the middle masts 12.

Figure 2:
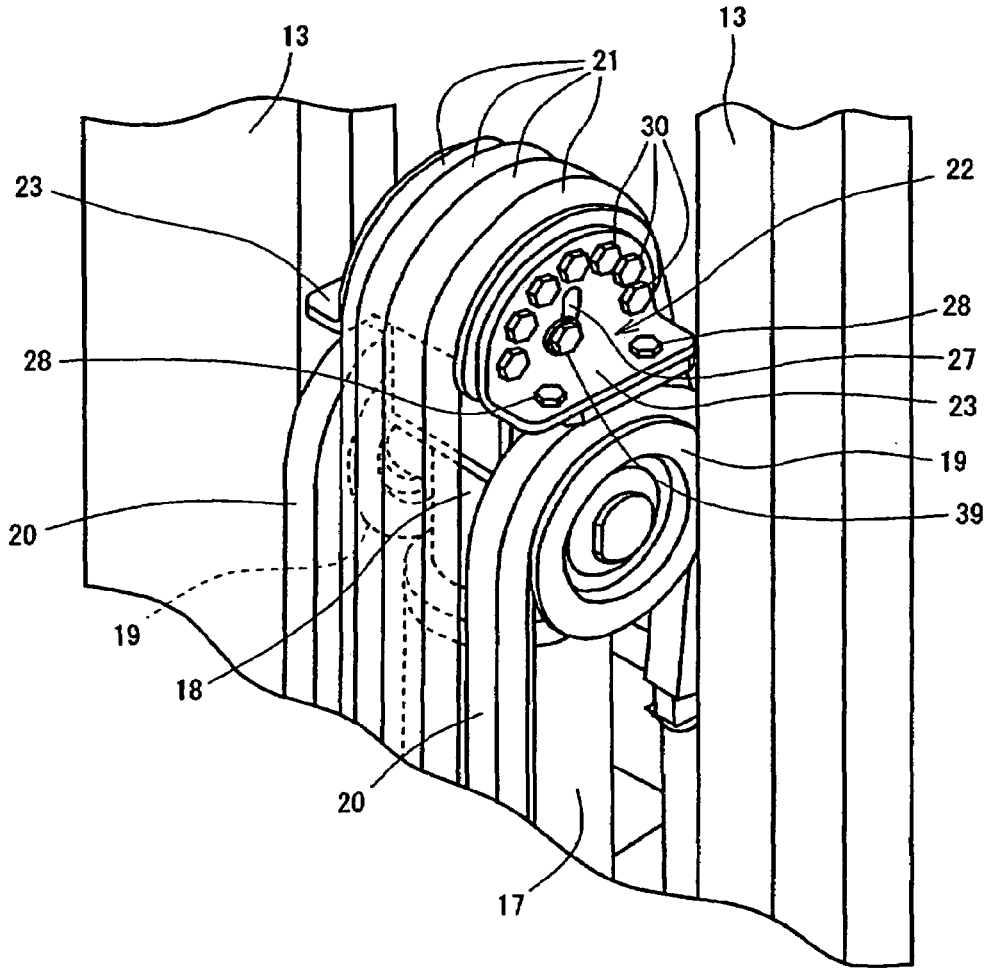
FIG. 2 is a partially enlarged perspective view of the lift device according to the preferred embodiment of the present invention.

A front cylinder 17 as a hydraulic cylinder is provided upright at the lower position between the inner masts 13 and has a piston rod 18 as shown in FIG. 2. A pair of pulleys 19 are provided on opposite sides of the upper end portion of the piston rod 18. The pulleys 19 are disposed coaxially in such orientation that the axes thereof extend along the width of the vehicle, and the top of each pulley 19 is located at substantially the same height as the top of the upper end portion of the piston rod 18. A chain 20 is wound around each pulley 19. Each chain 20 is connected at one end thereof (on the rear side) to the inner mast 13 and at the other end thereof (on the front side) to the lift bracket 14. Thus, as the piston rod 18 extends out of the front cylinder 17, the lift bracket 14 is moved upward along the inner masts 13 by the chains 20.

A guide mechanism 22 is provided on the top end of the piston rod 18 for guiding hoses. In the preferred embodiment shown in FIG. 1, a pair of forks 44 is installed on the lift bracket 14. It is noted that, however, the lift bracket 14 is configured to allow installation of any hydraulically-operable attachment in a detachable manner. For this purpose, the lift device 10 includes hydraulic piping for supplying hydraulic fluid from the vehicle to the attachment. As shown in FIGS. 1 and 2, the hydraulic piping includes four hoses 21 through which the hydraulic fluid is fed to the attachment. The four hoses 21 are arranged so that they extend along the front cylinder 17 on the rear side and on the front side thereof. The four hoses 21 are guided by the guide mechanism 22.

Figure 3:
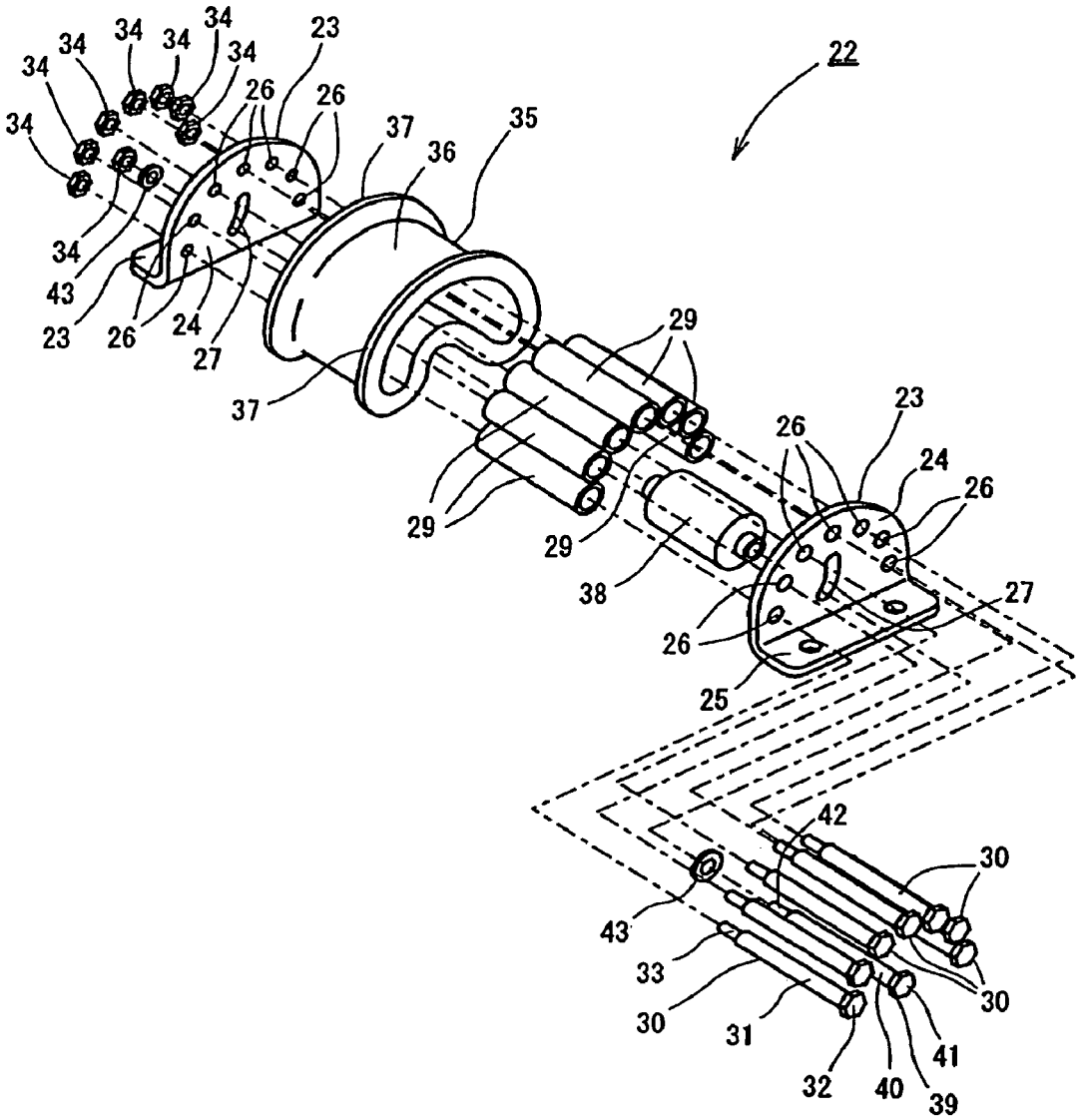
FIG. 3 is an exploded perspective view of a guide mechanism according to the preferred embodiment of the present invention.

As shown in FIG. 3, the guide mechanism 22 includes a plurality of guide rollers 29, an endless band 35 which is fitted around the guide rollers 29 to form an arc-shaped guide surface for supporting the hoses 21, a tension roller 38 as a tension provider for providing tension to the endless band 35 and a pair of support members 23 for supporting the guide rollers 29 and the tension roller 38.

Each support member 23 is made of a bent metallic plate having a semicircular-shaped and includes an upright portion 24 which has a plurality of holes 26 drilled therethrough and a horizontal portion 25 which is fixed to the top end of the piston rod 18. The plurality of holes 26 are arranged along the arc-shaped outer peripheral edge of the upright portion 24, or the holes 26 are located on the circumference of a circle. The upright portion 24 has an elongated hole 27 extending vertically for supporting the tension roller 38 at one end thereof. The position where the tension roller 38 is supported by the upright portions 24 is adjustable within the vertical length of the elongated holes 27. The horizontal portions 25 of the respective support members 23 are fixed to the top of the upper end portion of the piston rod 18 by bolts 28 as shown in FIG. 2 in such a way that the upright portions 24 face each other. The plurality of guide rollers 29 are arranged horizontally between the upright portions 24, and the tension roller 38 is disposed under those guide rollers 29 which are located at the middle of the array of guide rollers 29.

Each guide roller 29 is cylindrical and loosely fitted over a shaft member 30 which is supported horizontally by the support members 23. Thus, each guide roller 29 is rotatable relative to the respective shaft member 30. Each shaft member 30 has a shaft portion 31 and a head portion 32 having a diameter greater than that of the shaft portion 31. The head portion 32 serves to prevent the shaft member 30 from falling off from the hole 26. Each shaft portion 31 has an external thread 33 at its end, and a nut 34 is screwed on the external thread 33 thereby to completely prevent the shaft member 30 from falling off from the hole 26. Obviously, the plurality of guide rollers 29 are arranged on an arc.

Figure 4:
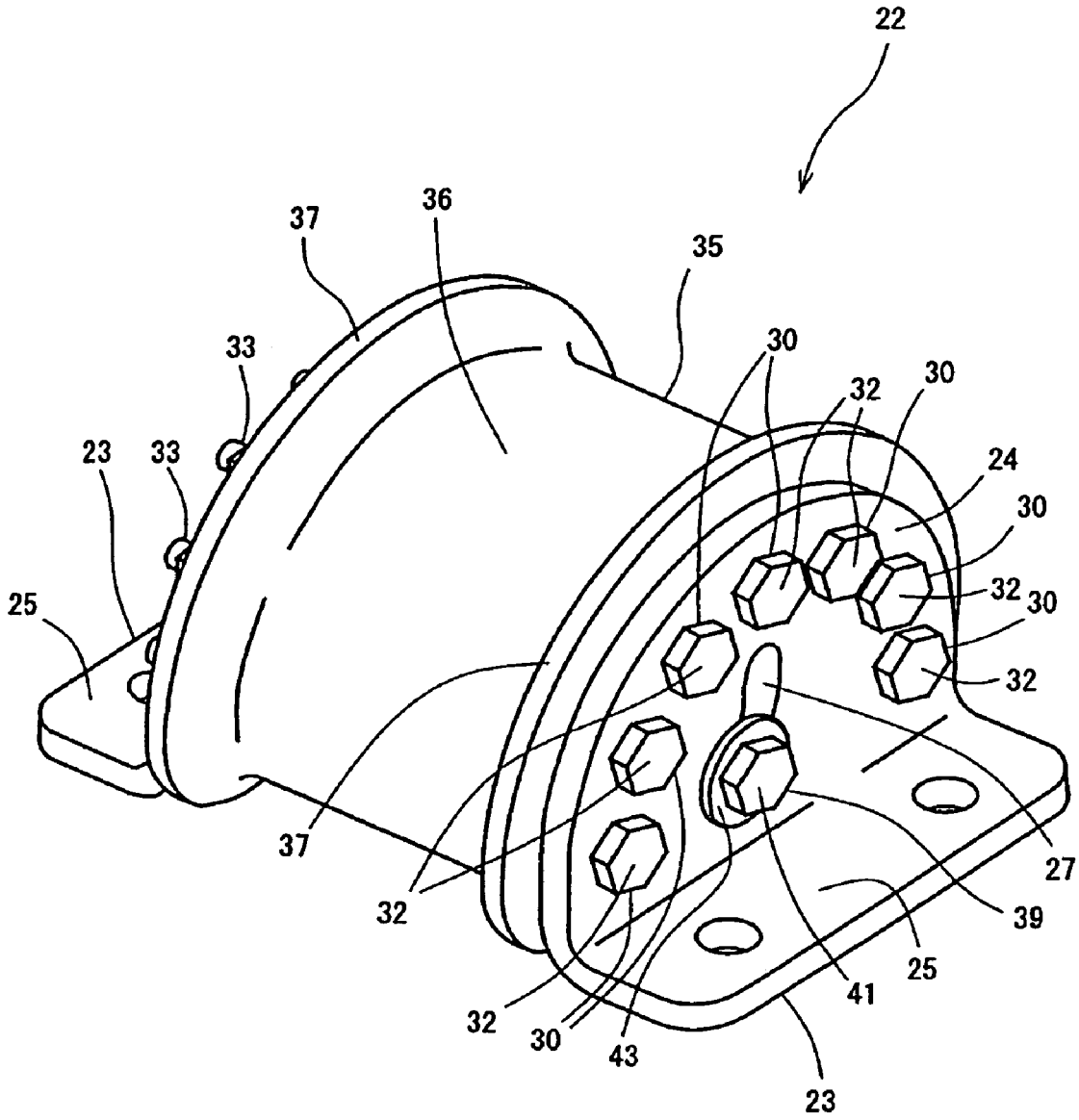
FIG. 4 is a perspective view of the guide mechanism according to the preferred embodiment of the present invention.
Figure 5:
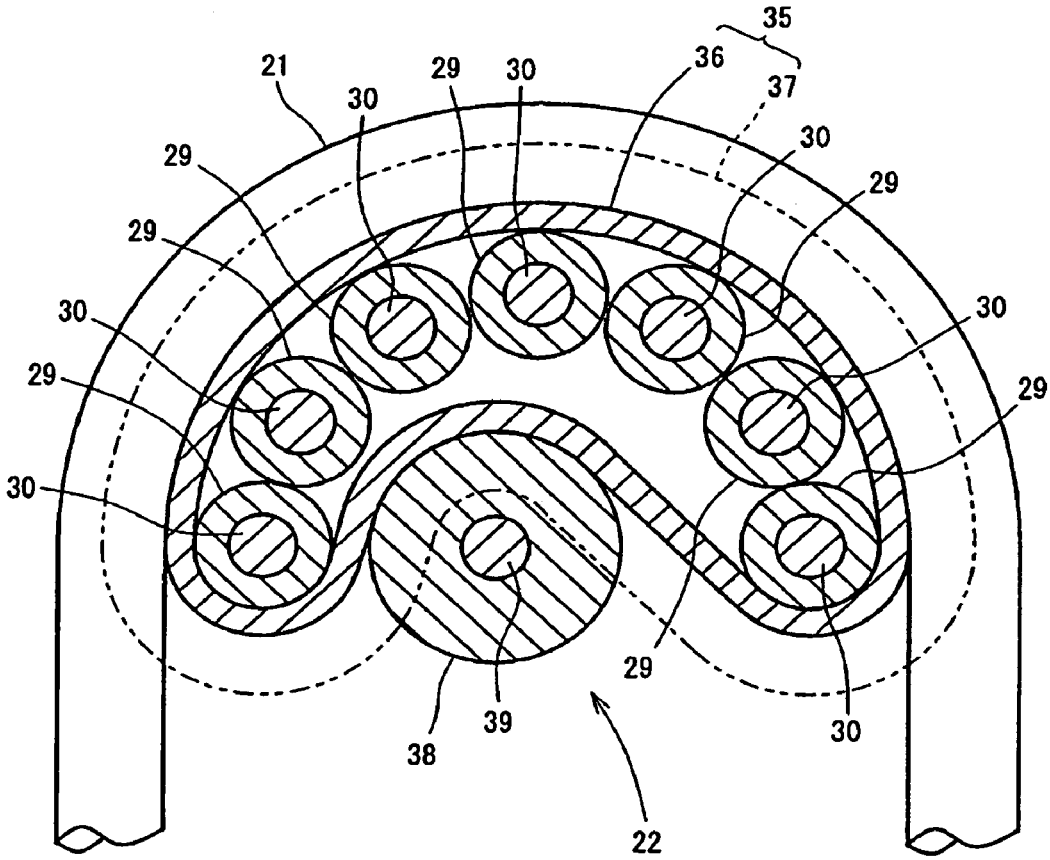
FIG. 5 is a side cross-sectional view of the guide mechanism according to the preferred embodiment of the present invention.

The following will describe the endless band 35 fitted around the guide rollers 29. The endless band 35 is made of rubber material having sufficient elasticity. The endless band 35 has a flat-belt portion 36 whose outer surface provides the guide surface for guiding the hoses 21 and spaced endless ribs 37 as a hose-falling-off preventer extending on opposite sides of the flat-belt portion 36 along the direction in which the endless band 35 travels around the guide rollers 29 for preventing the hoses 21 from falling off from the flat-belt portion 36. As shown in FIG. 4, the endless rib 37 has such a height that the endless rib 37 protrudes upwardly from the arc-shaped peripheral edge or the upper periphery of the upright portion 24 of the support member 23 when the endless band 35 is fitted around the guide rollers 29. The endless ribs 37 serves to prevent the hoses 21 from moving in lateral direction or falling off from the endless band 35 and also from coming into contact with the support members 23. Since the endless band 35 is fitted around the guide rollers 29 which are arranged along an arc, the guide surface formed on the flat-belt portion 36 is arc-shaped, as shown in FIG. 5. The arc-shaped guide surface has such a curvature that allows the hoses 21 to easily turn in reversible directions. That is, the radius of curvature corresponds to the diameter of the pulley of conventional lift devices. Thus, the curved state of the hoses 21 being guided by the endless band 35 is substantially the same as that in the conventional lift devices, but the height of the guide mechanism 22 is about half of the height or the diameter of the pulley of the conventional lift devices.

The following will describe the tension roller 38 for providing appropriate tension to the endless band 35. The tension roller 38 is pressed against the endless band 35 from beneath thereby to tension the endless band 35, as shown in FIG. 5. The tension roller 38 has a diameter greater than those of the guide rollers 29 and is supported by the support members 23 through a shaft member 39. As shown in FIG. 3, the shaft member 39 is similar to the shaft members 30 for the guide rollers 29, having a shaft portion 40 and a head portion 41. The shaft portion 40 extends horizontally and is inserted through the elongated holes 27 of the support members 23. The tension roller 38 is loosely fitted over the shaft portion 40. The shaft portion 40 has an external thread 42 at its end, and the nut 34 is screwed on the external thread 42. Thus, the nut 34 and the head portion 41 of the shaft member 39 prevent the shaft member 39 from falling off from the support members 23.

Two washers 43 are fitted on the shaft member 39 such that they are located between the head portion 41 of the shaft member 39 and its adjacent support member 23 and between the nut 34 and its adjacent support member 23, respectively. The elongated hole 27 is formed with a given vertical length in each support member 23, so that the supported position of the shaft member 39 with respect to the support members 23 is adjustable within the vertical length of the elongated hole 27. The tension of the endless band 35 is adjusted according to the supported position of the shaft member 39. When the shaft member 39 is supported at an upper position of the elongated hole 27, the tension of the endless band 35 becomes greater. On the other hand, when the shaft member 39 is supported at a lower position of the elongated hole 27, the tension of the endless band 35 becomes smaller.

The following will describe the operation of the lift device 10. When the front cylinder 17 is activated to raise the piston rod 18 in a state that the lift bracket 14 is located at the lowest position with respect to the inner masts 13, the lift bracket 14 rise through the chains 20. At this time, the hoses 21 are guided by the guide mechanism 22. As the piston rod 18 rises, the part of the hoses 21 in front of the front cylinder 17 moves to the rear side of the front cylinder 17 through the guide mechanism 22.

As the hoses 21 are moved, the endless band 35, which supports the hoses 21, travels around the guide rollers 29. Since the guide rollers 29 are rotatably supported by the support members 23 and the appropriate tension of the endless band 35 is maintained by the tension roller 38, the endless band 35 smoothly and stably travels around the guide rollers 29. The guide surface of the endless band 35 is in surface contact with the hoses 21, so that the hoses 21 receive uniform contact pressure from the endless band 35 and, therefore, slippage of the endless band 35 relative to the endless band 35 rarely occurs. Furthermore, the lateral movement of the hoses 21 on the flat-belt portion 36 of the endless band 35 is restrained by the endless ribs 37 of the endless band 35, thus the hoses 21 being prevented from falling off from the endless band 35. When the lift bracket 14 rises and lowers repeatedly, the endless band 35 fitted around the guide rollers 29 may be damaged, but it is extremely improbable that the hoses 21 are damaged.

The following advantageous effects are obtained according to the lift device 10 of the preferred embodiment.

(1) The hoses 21, which are in surface contact with the arc-shaped guide surface of the endless band 35, receive therefrom uniform contact pressure without being subjected to application of local pressure, with the result that the hoses 21 are very rarely damaged by such abnormal pressure.

(2) When the hoses 21 are moved while being guided by the guide mechanism 22, the endless band 35 travels around the guide rollers 29. Since the hoses 21 are in surface contact with the guide surface of the endless band 35, the hoses 21 rarely slip relative to the endless band 35, with the result that the damage of the hoses 21 due to the slipping of the hoses 21 relative to the guide mechanism 22 is substantially prevented.

(3) The endless ribs 37 which are provided on opposite sides of the endless band 35 along the traveling direction of the endless band 35 serve to prevent the hoses 21 from falling off from the endless band 35. The hoses 21 are not in contact with the guide mechanism 22 other than the endless band 35 and, therefore, load on the hoses 21 is suppressed.

(4) The tension roller 38 which is provided in the guide mechanism 22 for applying appropriate tension to the endless band 35 helps to prevent the hoses 21 from slipping relative to the endless band 35, thus realizing smooth traveling of the endless band 35 and stable guiding of the hoses 21 by the guide mechanism 22.

(5) The tension roller 38 which is supported by the support members 23 is adjustable to change its supported position with respect to the support members 23. By thus changing the supported position of the tension roller 38, the tension of the endless band 35 is adjustable according to the supported position of the tension roller 38. Thus, for example, if the endless band 35 is extended due to the prolonged use thereby to cause the tension of the endless band 35 to be insufficient or loose, appropriate tension is provided to the endless band 35 by changing the supported position of the tension roller 38. Furthermore, in case of changing the endless band 35 for one of different type, appropriate tension may be provided to the new endless band 35 in accordance with the type of that endless band 35 by changing the supported position of the tension roller 38.

(6) Repeated rising and lowering of the lift bracket 14 may damage the endless band 35 fitted around the guide rollers 29, but it is extremely improbable that the hoses 21 are damaged. Thus, if the endless band 35 is damaged, only the damaged endless band 35 need be replaced, which is much easier in comparison with the case of replacing the hose 21 if it is damaged.

(7) The vibration and shock caused during traveling of the vehicle and transmitted to the guide mechanism 22 can be absorbed by the endless band 35 which is made of elastic rubber material. Thus, the vibration and the shock to the hoses 21 are reduced, with the result that the endless band 35 contributes to preventing the damage of the hoses 21 due to the vibration and the shock.

(8) The use of the endless band 35 in place of a pulley in a conventional lift device for guiding a hose prevents the hoses 21 from damage. Furthermore, the height of the guide mechanism 22 of the present invention is reduced to half of the height or the diameter of the pulley of the conventional lift device without changing the curved state of the guided hoses 21. This provides a greater vertical front view around the guide mechanism 22. Since the height of the guide mechanism 22 is reduced to half of that of the conventional lift device, the reduced height of the guide mechanism which corresponds to half of the diameter of the pulley of the conventional lift device can be added to the free lift distance, thus the free lift distance being increased.

Figure 6:
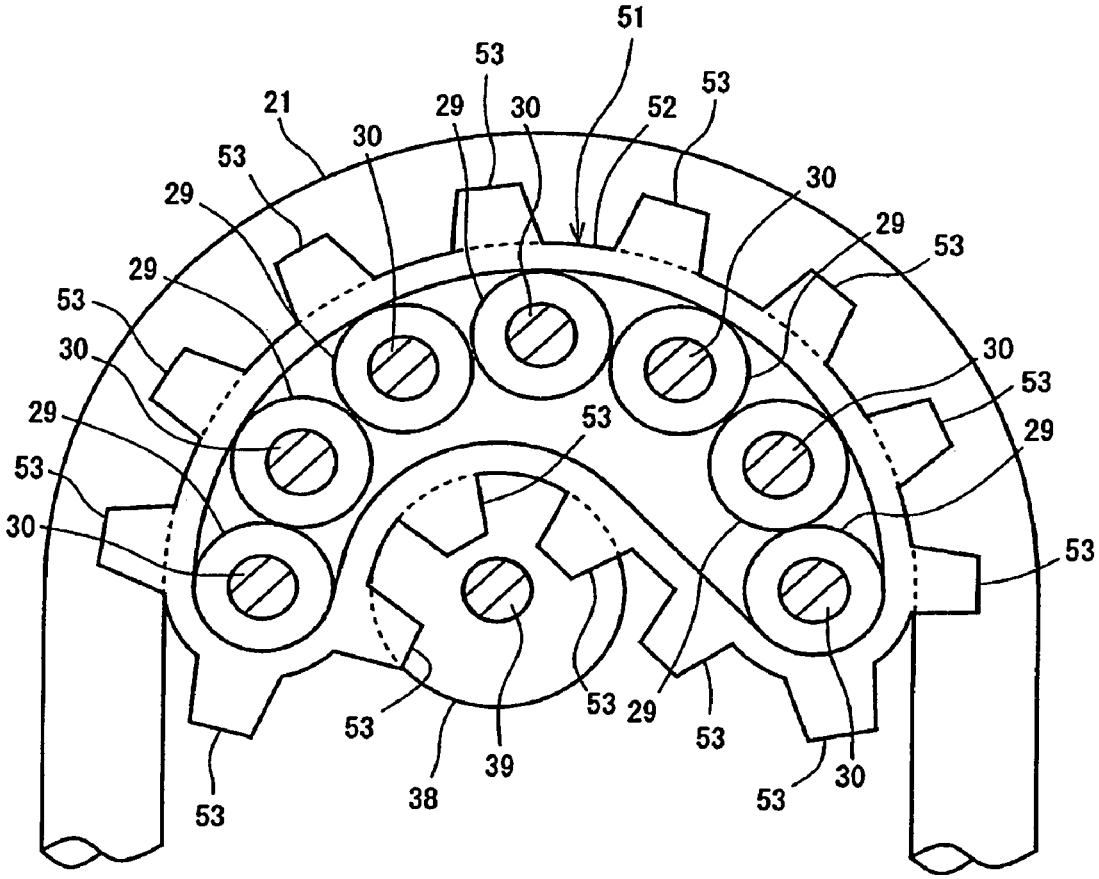
FIG. 6 is a side view of an endless band according to an alternative embodiment.

The following will describe an alternative embodiment of the endless band in the lift device 10 with reference to FIG. 6. FIG. 6 is a side view showing the endless band 51 of this alternative embodiment. Means for preventing hoses from falling off in the endless band 51 of the alternative embodiment is different from the endless rib 37 of the preferred embodiment described above. As shown in FIG. 6, the endless band 51 has a flat-belt portion 52 and a plurality of projections 53 as the hose-falling-off preventer provided on each side of the flat-belt portion 52 and spaced at a constant interval for preventing the hoses 21 from falling off the endless band 51. Each projection 53 has a predetermined length in the traveling direction of the endless band 51. The plurality of projections 53 prevents the hoses 21 from falling off from the endless band 51.

The endless band 51 is less capable of preventing the hoses 21 from falling off from the endless band 51 in comparison with the endless band 35 of the preferred embodiment described above. However, when the endless band 51 is set over the guide rollers 29 with a smaller curvature or when the endless band 51 receives a greater force from the tension roller 38, the spaced interval between any two adjacent projections 53 prevent the projections 53 from being deformed excessively. Thus, deformation of and load on the flat-belt portion 52 due to the deformation of the projections 53 is reduced, with the result that the period of serviceable life of the endless band 51 is extended further.

The present invention is not limited to the above-described embodiments, but may be modified into various alternative embodiments, as exemplified below.

The material of the guide rollers has not been specified in the above embodiments, but the guide rollers should preferably be made of metal or resin as viewed from practical application of the guide rollers. Furthermore, a bearing may be provided between the shaft member and the guide roller for improved smoothness of sliding therebetween. In this case, it is preferable that the bearing should be of oilless type for the sake of ease of maintenance.

In the above preferred embodiment, the endless band is made of the rubber material having sufficient elasticity. However, a thin metal plate (or a blade) may be embedded in the flat-belt portion of the endless band for reinforcement and hence for prolonged period of serviceable life of the endless band. In addition to the rubber material, resin may be used for the material of the endless band.

In the above preferred embodiment, the guide mechanism is designed to guide four hoses for supplying therethrough the hydraulic fluid to the attachment. The number of hose is not limited to four, but the guide mechanism may be made to guide, for example, two or six hoses.

In the above preferred embodiment, the tension provider or the tension roller 38 is rotatable. However, the tension provider does not have to be rotatable, but it may be made of any material having high sliding characteristics relative to the endless band.

The preferred embodiment has been described with reference to a lift device having a single hydraulic front cylinder located adjacent to the center between the masts. Alternatively, two hydraulic front cylinders may be provided upright within and along the inner masts.

Though the above preferred embodiment has been also described with reference to the lift device for the three-stage mast forklift truck, the present invention is also applicable to other full free lift mast forklift trucks. For example, the present invention is applicable to a two-stage full free lift mast forklift truck.

Although illustrative embodiments of the present invention, and various modifications thereof, have been described in detail herein with reference to the accompanying drawings, it is to be understood that the invention is not limited to these precise embodiments and the described modifications, and that various changes and further modifications may be effected therein by one skilled in the art without departing from the scope or spirit of the invention as defined in the appended claims.

What is claimed is:

1. A lift device for an industrial vehicle comprising:

masts;

a hydraulic cylinder provided substantially upright between the masts, the hydraulic cylinder having a piston rod;

a pulley provided on a lateral side of an upper end portion of the piston rod;

a chain wound around the pulley;

a lift bracket connected to the chain, the lift bracket being movable up and down through the chain by extension and retraction of the piston rod;

a hose provided for supplying hydraulic fluid to an attachment installed on the lift bracket; and a guide mechanism provided on a top end of the piston rod for guiding the hose, the guide mechanism including:

a plurality of rollers;

a support member rotatably supporting the plurality of rollers;

an endless band fitted around the plurality of rollers so that the endless band forms an arc-shaped guide surface for supporting the hose, the endless band traveling around the plurality of rollers with movement of the hose; and a tension provider for providing tension to the endless band, wherein the support member has an upright portion with an elongated hole, a shaft member being inserted through the elongated hole for supporting the tension provider.

* * * * *

UNITED STATES PATENT AND TRADEMARK OFFICE

CERTIFICATE OF CORRECTION

PATENT NO. : 7,395,901 B2
APPLICATION NO. : 11/487257
DATED : July 8, 2008
INVENTOR(S) : Hirohito Hayashi It is certified that error appears in the above-identified patent and that said Letters Patent is hereby corrected as shown below:

In the Specification

Column 1, line 28, please delete "bracket are moved" and insert therefore -- bracket is moved --;

Column 2, line 2, please delete "life device" and insert therefore -- lift device --;

Column 2, line 18, please delete "damage hose" and insert therefore -- damaged hose --;

Column 4, line 18, please delete "semicircular-shaped" and insert therefore -- semicircular shape --;

Column 4, line 28, please delete "holes 27" and insert therefore -- hole 27 --;

Column 4, line 62, please delete "serves to prevent the hoses 21 from moving in lateral direction" and insert therefore -- serve to prevent the hoses 21 from moving in a lateral direction --;

Column 5, line 7, please delete "height or the" and insert therefore -- height of the --;

Column 5, line 13, please delete "greater than those of" and insert therefore -- greater than that of --;

Column 5, line 45, please delete "rise through" and insert therefore -- rises through --;

Column 5, line 63, please delete "hoses 21 being prevented" and insert therefore -- hoses 21 are prevented --;

Column 6, line 2, please delete "embodiment." and insert therefore -- embodiment: --;

Column 6, line 40, please delete "of different" and insert therefore -- of a different --;

UNITED STATES PATENT AND TRADEMARK OFFICE

CERTIFICATE OF CORRECTION

PATENT NO. : 7,395,901 B2
APPLICATION NO. : 11/487257
DATED : July 8, 2008
INVENTOR(S) : Hirohito Hayashi It is certified that error appears in the above-identified patent and that said Letters Patent is hereby corrected as shown below:

Column 6, lines 61-62, please delete "hoses 21 from damage." and insert therefore -- hoses 21 from being damaged. --;

Column 6, line 64, please delete "height or the" and insert therefore -- height of the --;

Column 7, line 5, please delete "being increased" and insert therefore -- is increased --; and Column 7, line 53, please delete "number of hose" and insert therefore -- number of hoses --.

Signed and Sealed this

Third Day of November, 2009

David J. Kappos

David J. Kappos
*Director of the United States Patent and Trademark Office*